US006264201B1

(12) United States Patent
Holsten et al.

(10) Patent No.: US 6,264,201 B1
(45) Date of Patent: Jul. 24, 2001

(54) WATER BALLOON GAME

(76) Inventors: William A. Holsten; Janet A. Holsten, both of 16 Twin Oaks Rd., Parsippany, NJ (US) 07054

( * ) Notice: Subject to any disclaimer, the term of this patent is extended or adjusted under 35 U.S.C. 154(b) by 0 days.

(21) Appl. No.: 09/633,009

(22) Filed: Aug. 4, 2000

(51) Int. Cl.[7] ..... A63B 63/00; F41J 5/00
(52) U.S. Cl. ..... 273/384; 273/457
(58) Field of Search ..... 273/317, 374, 273/384, 390, 440, 457, 459, 460

(56) References Cited

U.S. PATENT DOCUMENTS

| | | | | |
|---|---|---|---|---|
| 4,093,228 | * | 6/1978 | Pierce | 273/384 |
| 4,702,480 | * | 10/1987 | Popeski et al. | 273/384 |
| 4,943,064 | * | 7/1990 | Smith, Jr. | 273/384 |
| 5,482,292 | * | 1/1996 | Stone | 273/384 |
| 5,839,981 | * | 11/1998 | Rudell et al. | 273/384 X |
| 5,848,793 | * | 12/1998 | Celis | 273/384 |
| 5,947,476 | * | 9/1999 | Rousay | 273/384 |

* cited by examiner

*Primary Examiner*—Raleigh W. Chiu
(74) *Attorney, Agent, or Firm*—Michael S. Neustel

(57) ABSTRACT

A water balloon game for providing amusement to individuals at events by bursting a balloon filled with water above a subject's head thereby effectively "dunking" the subject. The inventive device includes a wall member having a target and a support structure to maintain the wall member in a vertical position, a basket supported to an upper portion of the wall member by a support bar formed for receiving a balloon filled with a fluid such as water, a shaft pivotally attached to the wall member, a plate attached to the shaft positioned in front of the target, and a puncturing member attached orthogonally to the end of the shaft opposite of the plate for puncturing the balloon when positioned within the basket. The shaft is pivotally attached to the wall member with pivot brackets and a pivot pin. The shaft is angled upwardly from the plate to the puncturing member. In use, a ball or similar object is thrown at the plate which forces the distal end of the shaft containing the puncturing member forwardly toward the balloon with the puncturing member puncturing the balloon which releases the fluid contained within upon a subject positioned upon a chair.

20 Claims, 5 Drawing Sheets

WATER BALLOON GAME

BACKGROUND OF THE INVENTION

1. Field of the Invention

The present invention relates generally to water dunking game devices and more specifically it relates to a water balloon game for providing amusement to individuals at events by bursting a balloon filled with water above a subject's head thereby effectively "dunking" the subject.

2. Description of the Prior Art

Water dunking devices have been in use for years. Typically, a conventional water dunking game devices are comprised of a large water tank filled with water which is large enough to receive a normal sized human, a platform structure that supports a subject above the water tank, a release mechanism that releasably supports the platform structure, and a target mechanism which is mechanically connected to the release mechanism to release the platform structure with the subject upon when the target is hit with an object such as a baseball.

Conventional water dunking devices are amusing and entertaining. However, conventional water dunking devices are extremely bulky and difficult to transport between locations. In addition, conventional water dunking devices require a significant amount of water which is difficult to locate. A further detriment of conventional water dunking devices is that they are relatively expensive to construct and maintain thereby making them not feasible for a smaller business or event. Also, conventional water dunking devices contain significant risks of injury to the individual being dunked as they are abruptly dropped into a water tank.

Examples of patented water related games include U.S. Pat. No. 5,947,476 to Rousay; U.S. Pat. No. 334,044 to Lopatin; U.S. Pat. No. 5,634,642 to Grandolfo; U.S. Pat. No. 5,839,981 to Rudell et al.; U.S. Pat. No. 4,909,518 to Erlandson et al. which are all illustrative of such prior art.

While these devices may be suitable for the particular purpose to which they address, they are not as suitable for providing amusement to individuals at events by bursting a balloon filled with water above a subject's head thereby effectively "dunking" the subject. Conventional water dunking games are not suitable for simple transportation between locations and are difficult to setup and maintain.

In these respects, the water balloon game according to the present invention substantially departs from the conventional concepts and designs of the prior art, and in so doing provides an apparatus primarily developed for the purpose of providing amusement to individuals at events by safely bursting a balloon filled with water above a subject's head thereby effectively "dunking" the subject.

SUMMARY OF THE INVENTION

In view of the foregoing disadvantages inherent in the known types of water games now present in the prior art, the present invention provides a new water balloon game construction wherein the same can be utilized for providing amusement to individuals at events by bursting a balloon filled with water above a subject's head thereby effectively "dunking" the subject.

The general purpose of the present invention, which will be described subsequently in greater detail, is to provide a new water balloon game that has many of the advantages of the water games mentioned heretofore and many novel features that result in a new water balloon game which is not anticipated, rendered obvious, suggested, or even implied by any of the prior art water games, either alone or in any combination thereof.

To attain this, the present invention generally comprises a wall member having a target and a support structure to maintain the wall member in a vertical position, a basket supported to an upper portion of the wall member by a support bar formed for receiving a balloon filled with a fluid such as water, a shaft pivotally attached to the wall member, a plate attached to the shaft positioned in front of the target, and a puncturing member attached orthogonally to the end of the shaft opposite of the plate for puncturing the balloon when positioned within the basket. The shaft is pivotally attached to the wall member with pivot brackets and a pivot pin. The shaft is angled upwardly from the plate to the puncturing member. In use, a ball or similar object is thrown at the plate which forces the distal end of the shaft containing the puncturing member forwardly toward the balloon with the puncturing member puncturing the balloon which releases the fluid contained within upon a subject positioned upon a chair below the basket.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a water balloon game that will overcome the shortcomings of the prior art devices.

A second object is to provide a water balloon game for providing amusement to individuals at events by bursting a balloon filled with water above a subject's head thereby effectively "dunking" the subject.

Another object is to provide a water balloon game that is easy to construct and simple to maintain.

An additional object is to provide a water balloon game that is easily transported between locations.

A further object is to provide a water balloon game that does not require a large water tank.

Another object is to provide a water balloon game that saves the amount of water required to be utilized with a water game amusement device.

A further object is to provide a water balloon game that can be utilized by businesses, find-raising organizations and at various events.

Another object is to provide a water balloon game that can be utilized within strict water usage restrictions often times implemented by municipalities during periods of drought.

An additional object is to provide a water balloon game that does not require an individual to fall into a large water tank thereby reducing the risk of injury.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
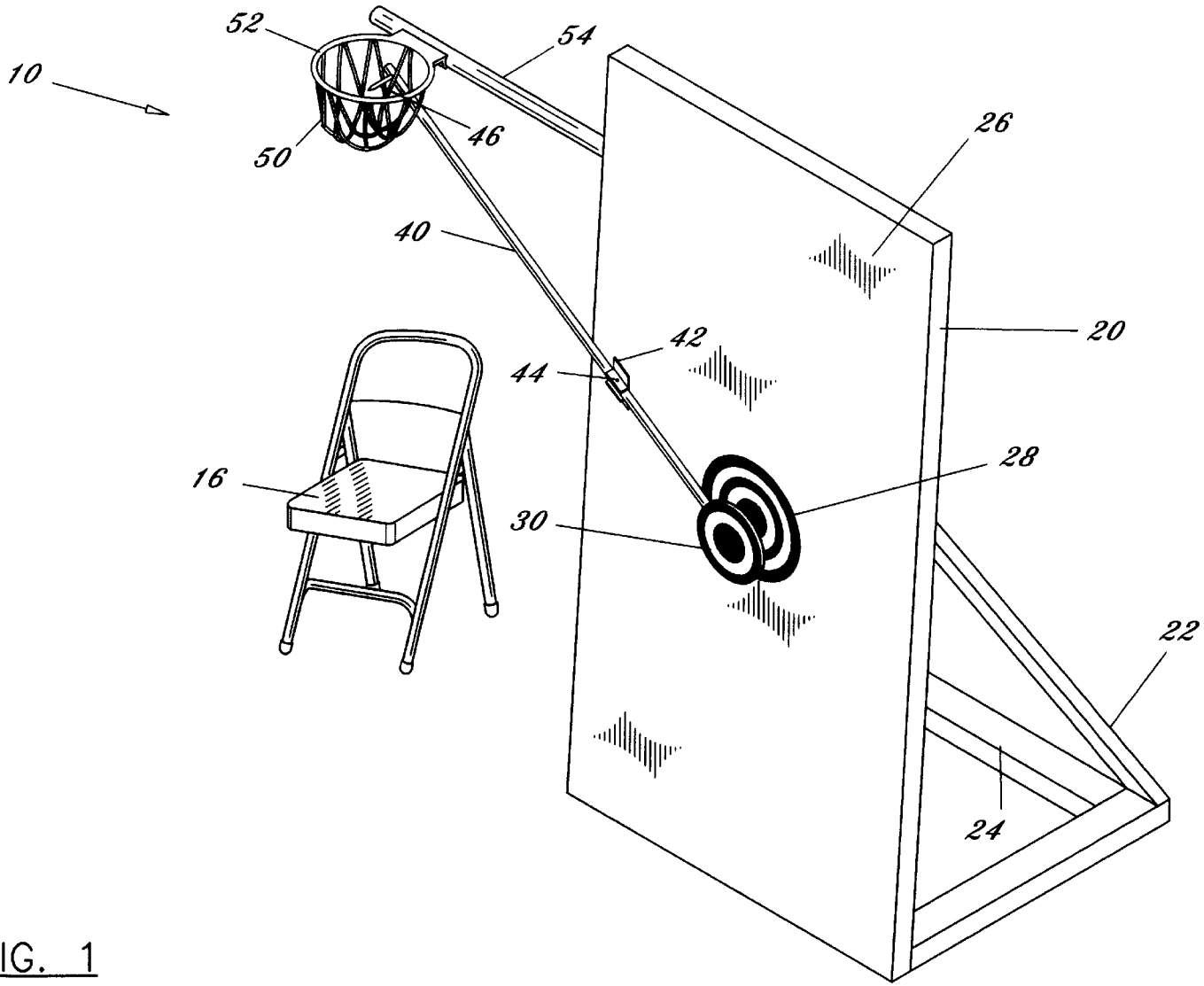
FIG. 1 is an upper perspective view of the present invention.

Turning now descriptively to the drawings, in which similar reference characters denote similar elements throughout the several views, FIGS. 1 through 5 illustrate a water balloon game 10, which comprises a wall member 20 having a target 28 and a support structure to maintain the wall member 20 in a vertical position, a basket 50 supported to an upper portion of the wall member 20 by a support bar 54 formed for receiving a balloon 12 filled with a fluid such as water, a shaft 40 pivotally attached to the wall member 20, a plate 30 attached to the shaft 40 positioned in front of the target 28, and a puncturing member 46 attached orthogonally to the end of the shaft 40 opposite of the plate 30 for puncturing the balloon 12 when positioned within the basket 50. The shaft 40 is pivotally attached to the wall member 20 with pivot brackets 42 and a pivot pin 44. The shaft 40 is angled upwardly from the plate 30 to the puncturing member 46. In use, a ball 14 or similar object is thrown at the plate 30 which forces the distal end of the shaft 40 containing the puncturing member 46 forwardly toward the balloon 12 with the puncturing member 46 puncturing the balloon 12 which releases the fluid contained within upon a subject positioned upon a chair 16 below the basket.

Figure 2:
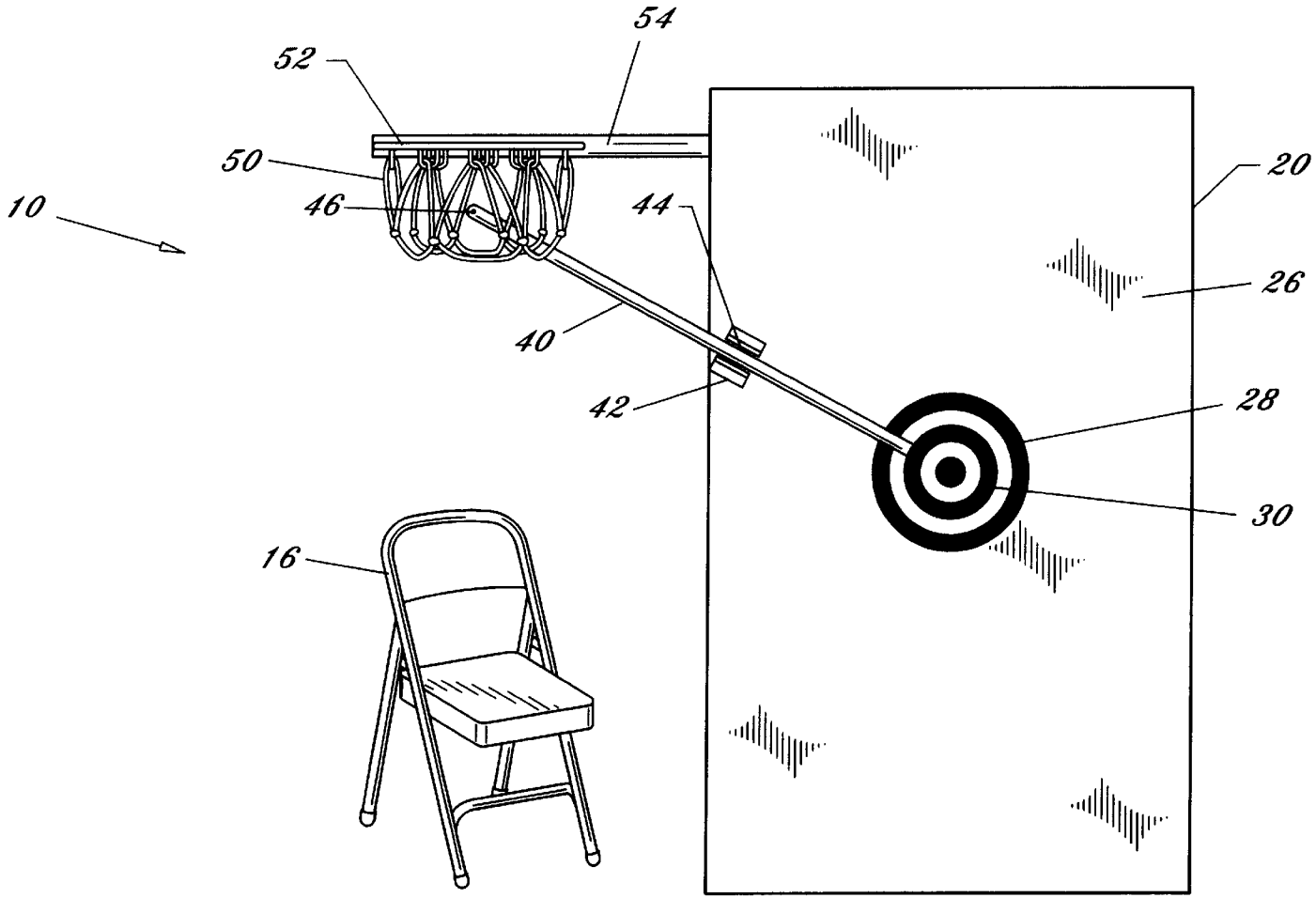
FIG. 2 is a front view of the present invention.

As shown in FIGS. 1 and 2 of the drawings, the wall member 20 is a generally vertical structure having a planar rectangular shape. However, it can be appreciated that the wall member 20 may be comprised of various structures and shapes.

As shown in FIGS. 1 through 4 of the drawings, the wall member 20 includes a front surface 26 having a target 28 positioned there upon. The target 28 is preferably shaped as a conventional target 28 with a series of rings having various colors and patterns. The target 28 is preferably positioned directly behind the plate 30 attached to the shaft 40 thereby forming a continuous target 28 for an individual to aim at. It can be appreciated that various designs for the target 28 may be utilized.

As shown in FIGS. 1 and 2 of the drawings, a base 24 and at least one support brace 22 are attached to the wall member 20 for supporting the wall member 20 within a substantially vertically orientated position. It can be appreciated that the wall member 20 may be supported at various angles with respect to a ground surface. The support brace 22 and the base 24 may also be removable for allowing easy disassembly and storage during nonuse or transportation.

Figure 3:
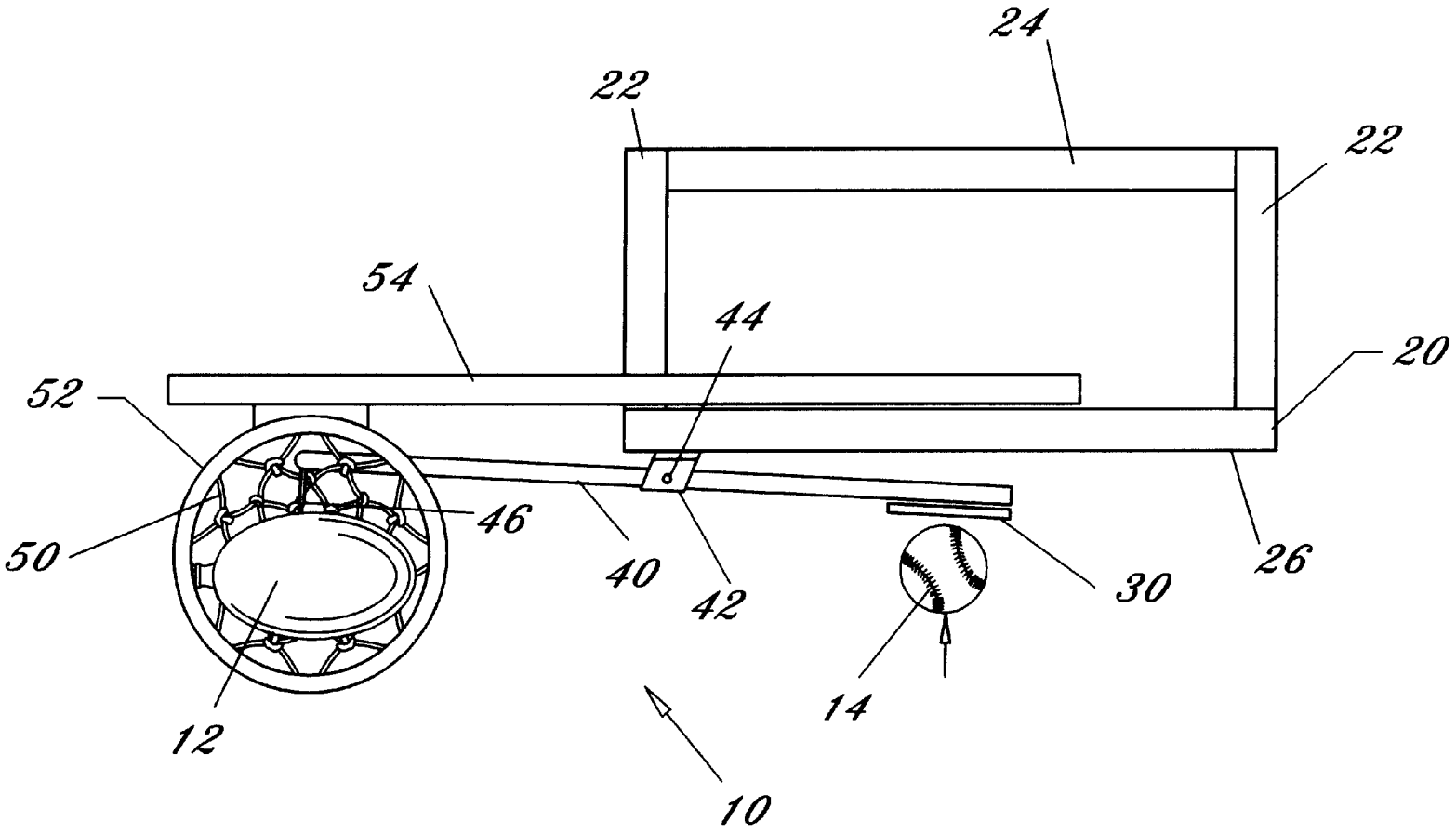
FIG. 3 is a top view of the present invention with a balloon filled with a fluid within the basket.
Figure 4:
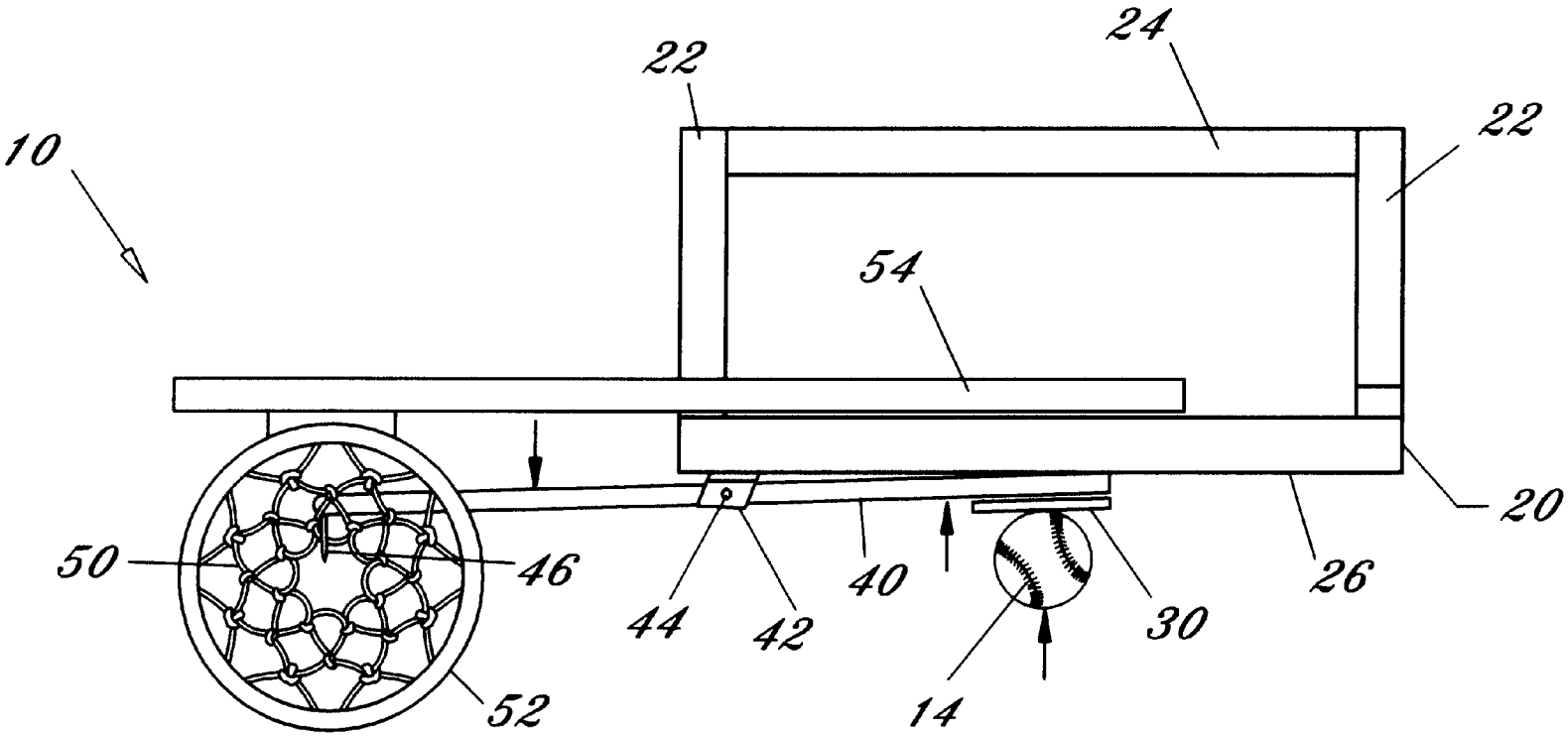
FIG. 4 is a top view of the present invention with the target engaged by an object and with the balloon with fluid burst.

As shown in FIGS. 1 through 4 of the drawings, a rigid shaft 40 is provided having a first end and a second end. As further shown in FIGS. 1 through 4, the shaft 40 is pivotally attached to the wall member 20. As best shown in FIGS. 3 and 4 of the drawings, the shaft 40 has a "normal position" for leaving the balloon 12 in a water filled state and a "puncture position" wherein the puncturing member 46 is positioned into the balloon 12 for puncturing the balloon 12.

As shown in FIGS. 1 through 4 of the drawings, one or more pivot brackets 42 pivotally support the central portion of the shaft 40 to the wall member 20. A pivot pin 44 preferably extends through the pivot brackets 42 to pivotally support the shaft 40 in an angled position. As best shown in FIG. 2 of the drawings, the shaft 40 is preferably supported with the first end containing the plate 30 in a lower vertical position with respect to the second end of the shaft 40 containing the puncturing member 46.

As shown in FIGS. 1 through 4 of the drawings, a plate 30 is attached to the first end of the shaft 40 opposite of the puncturing member 46. As shown in FIGS. 1 and 2 of the drawings, the plate 30 is preferably circular shaped to conform to the target 28 upon the wall member 20, however various other shaped and designs may be utilized. The plate 30 preferably has a corresponding target 28 design which corresponds with the target 28 upon the wall member 20 directly behind the plate 30. The plate 30 is preferably constructed of a rigid material which is capable of being engaged repeatedly by an object such as a ball 14.

As shown in FIGS. 1 through 5 of the drawings, a basket 50 is attached to the wall member 20. As shown in FIG. 3 of the drawings, the basket 50 is formed for receiving various sizes and shapes of a balloon 12 filled with fluid.

As shown in FIGS. 1 through 4 of the drawings, the basket 50 is attached to the wall member 20 by a support bar 54 extending horizontally from the wall member 20. As further shown in FIGS. 1 through 4, the basket 50 includes a rim 52 and netting formed for receiving various sizes of a balloon 12. The netting is structured to having openings that allow fluid within the balloon 12 to pass through the basket 50 when the fluid filled balloon 12 is punctured. As shown in FIG. 4 of the drawings, the netting of the basket 50 preferably includes a lower opening 56 for allowing a punctured balloon 12 to pass through. It can be appreciated that various designs and configurations of nettings and openings 56 may be utilized.

Figure 5:
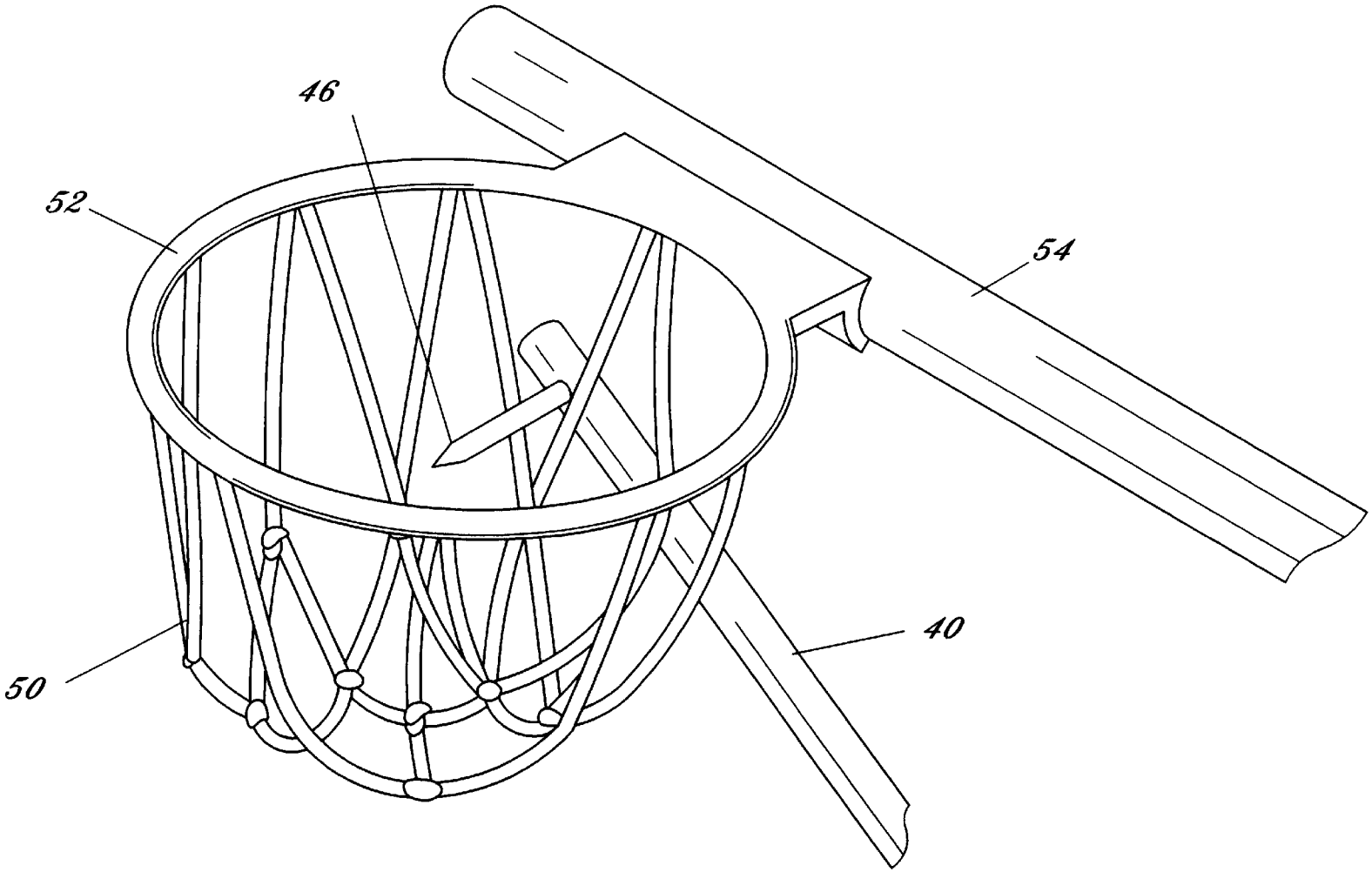
FIG. 5 is a magnified upper perspective view of the basket.

As shown in FIGS. 1 through 5 of the drawings, the puncturing member 46 is attached to the second end of the shaft 40 opposite of the plate 30. The puncturing member 46 penetrates the balloon 12 when the shaft 40 is within the "puncture position" as shown in FIG. 4 of the drawings. The puncturing member 46 is generally distally spaced from the balloon 12 when the shaft 40 is within the normal position thereby allowing the balloon 12 to remain in a fluid filled state as shown in FIG. 3 of the drawings. The puncturing member 46 is an elongated member with a pointed end, similar to a needle or a spike, that is capable of penetrating a fluid filled balloon 12. As best shown in FIG. 5 of the drawings, the puncturing member 46 is preferably orthogonally attached to the shaft 40.

In use, the user positions a fluid filled balloon 12 within the basket 50 with the shaft 40 in the "normal position". A subject is positioned directly below the basket 50 and the fluid filled balloon 12 either upon a chair 16 or standing. A participant is provided with one or more objects such as a ball 14 to throw at the plate 30. The participant throws the ball 14 which engages the plate 30 attached to the shaft 40 as shown in FIG. 3 of the drawings. As shown in FIG. 4 of the drawings, the force of the ball 14 engaging the plate 30 forces the shaft 40 to pivot upon the pivot brackets 42 which forces the puncturing member 46 forwardly into the fluid filled balloon 12 thereby puncturing the balloon 12 which allows the fluid within the balloon 12 to fall through the basket 50 upon the subject sitting with in the chair 16. The shaft 40 is repositioned into the "normal position" and the basket 50 is filled with another fluid filled balloon 12 and the above process is repeated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A water balloon game, comprising:

a wall member;

a shaft having a first end and a second end pivotally attached to said wall member, wherein said shaft has a normal position and a puncture position;

a plate attached to said first end of said shaft;

a basket attached to said wall member, wherein said basket is formed for receiving a balloon filled with fluid; and a puncturing member attached to said second end of said shaft, wherein said puncturing member penetrates said balloon when said shaft is within said puncture position and where said puncturing member is distally spaced from said balloon when said shaft is within said normal position.

2. The water balloon game of claim 1, wherein said wall member is a generally planar structure.

3. The water balloon game of claim 2, wherein said wall member includes a front surface and a target positioned upon said front surface.

4. The water balloon game of claim 3, wherein said target is concentrically positioned behind said plate.

5. The water balloon game of claim 4, including a base and at least one support brace attached to said wall member for supporting said wall member within a vertically orientated position.

6. The water balloon gate of claim 5, wherein said wall member is rectangular shaped.

7. The water balloon game of claim 1, wherein said plate is circular shaped.

8. The water balloon game of claim 7, wherein said plate has a target design.

9. The water balloon game of claim 1, including one or more pivot brackets pivotally supporting said shaft to said wall member.

10. The water balloon game of claim 9, including a pivot pin extending through said one or more pivot brackets to pivotally support said shaft.

11. The water balloon game of claim 10, wherein said shaft is supported with said first end in a lower vertical position with respect to said second end of said shaft.

12. The water balloon game of claim 11, wherein said shaft is an elongate rigid structure.

13. The water balloon game of claim 1, wherein said puncturing member is elongated with a pointed end.

14. The water balloon game of claim 13, wherein said puncturing member is orthogonally attached to said shaft.

15. The water balloon game of claim 1, wherein said puncturing member is comprised of a needle.

16. The water balloon game of claim 15, wherein said puncturing member is orthogonally attached to said shaft.

17. The water balloon game of claim 1, wherein said puncturing member is orthogonally attached to said shaft.

18. The water balloon game of claim 1, wherein said basket is attached to said wall member by a support bar.

19. The water balloon game of claim 18, wherein said basket includes a rim and netting formed for receiving said balloon and allowing fluid within said balloon to pass through said basket when punctured.

20. The water balloon game of claim 19, wherein said netting of said basket includes a lower opening for allowing a punctured balloon to pass through.

* * * * *